US009999982B2

(12) United States Patent
Gers-Barlag et al.

(10) Patent No.: US 9,999,982 B2
(45) Date of Patent: Jun. 19, 2018

(54) RAZOR HAVING A BRUSH OR BRISTLE HEAD

(71) Applicant: BEIERSDORF AG, Hamburg (DE)

(72) Inventors: Heinrich Gers-Barlag, Kummerfeld (DE); Yvonne Neumann, Hamburg (DE)

(73) Assignee: BEIERSDORF AG, Hamburg (DE)

( * ) Notice: Subject to any disclaimer, the term of this patent is extended or adjusted under 35 U.S.C. 154(b) by 16 days.

(21) Appl. No.: 14/905,040

(22) PCT Filed: Jul. 11, 2014

(86) PCT No.: PCT/EP2014/064940

§ 371 (c)(1),
(2) Date: Jan. 14, 2016

(87) PCT Pub. No.: WO2015/007646

PCT Pub. Date: Jan. 22, 2015

(65) Prior Publication Data

US 2016/0158951 A1 Jun. 9, 2016

(30) Foreign Application Priority Data

Jul. 16, 2013 (DE) ..... 10 2013 213 869

(51) Int. Cl.

| | |
|---|---|
| ***B26B 21/58*** | (2006.01) |
| ***B26B 21/22*** | (2006.01) |
| ***B26B 21/52*** | (2006.01) |
| ***B26B 21/40*** | (2006.01) |
| ***B26B 21/44*** | (2006.01) |

(52) U.S. Cl.

CPC ..... *B26B 21/58* (2013.01); *B26B 21/22* (2013.01); *B26B 21/4068* (2013.01); *B26B 21/443* (2013.01); *B26B 21/52* (2013.01); *B26B 21/522* (2013.01)

(58) Field of Classification Search

CPC . B26B 21/4068; B26B 21/443; B26B 21/522; B26B 21/58; B26B 21/22; B26B 21/52

See application file for complete search history.

(56) References Cited

U.S. PATENT DOCUMENTS

| | | | | |
|---|---|---|---|---|
| 4,170,821 A | | 10/1979 | Booth | |
| 4,378,635 A | | 4/1983 | Burch | |
| 4,720,917 A | | 1/1988 | Solow | |
| 4,845,848 A | * | 7/1989 | Strickland | B26B 21/40 30/32 |

(Continued)

FOREIGN PATENT DOCUMENTS

| | | |
|---|---|---|
| DE | 2851457 A1 | 6/1979 |
| DE | 29503575 U1 | 4/1995 |

(Continued)

*Primary Examiner* — Hwei C Payer

(74) *Attorney, Agent, or Firm* — Abel Law Group, LLP

(57) ABSTRACT

The invention relates to a razor and a method for producing a razor. In order to provide an improved razor, a razor (1) has a handle (10) having a gripping part (11) and a head part (12) for receiving a blade head (20), and the blade head (20), said blade head being in the form of a bristle head and/or brush head with bristles (29), at least one of the bristles having a razor blade (21).

13 Claims, 13 Drawing Sheets

(56) References Cited

U.S. PATENT DOCUMENTS

| | | | | | |
|---|---|---|---|---|---|
| 5,205,040 | A * | 4/1993 | Werner | B26B 21/20 | 30/346.56 |
| 5,351,401 | A * | 10/1994 | Werner | B26B 21/4006 | 30/41 |
| 5,903,978 | A | 5/1999 | Prochaska et al. | | |
| 6,505,403 | B1 * | 1/2003 | Andrews | B26B 21/00 | 30/29.5 |
| 6,598,303 | B2 * | 7/2003 | Bosy | B26B 21/225 | 30/50 |
| 7,730,619 | B2 | 6/2010 | Ozenick | | |
| 8,881,406 | B2 | 11/2014 | Glezermann | | |
| 2008/0072431 | A1 | 3/2008 | Ozenick | | |
| 2009/0260170 | A1 * | 10/2009 | Bagley | A46B 5/02 | 15/176.1 |
| 2012/0291289 | A1 | 11/2012 | Glezerman | | |
| 2016/0158951 | A1 * | 6/2016 | Gers-Barlag | B26B 21/22 | 30/34.05 |

FOREIGN PATENT DOCUMENTS

| | | | |
|---|---|---|---|
| DE | 20216827 | U1 | 4/2003 |
| FR | 2935920 | A1 | 3/2010 |
| GB | 419016 | A | 11/1934 |
| GB | 1594411 | A | 7/1981 |
| GB | 2 409 425 | A * | 6/2005 |
| GB | 2458520 | A | 9/2009 |
| WO | 2007116397 | A2 | 10/2007 |
| WO | 2010133134 | A1 | 11/2010 |

* cited by examiner

RAZOR HAVING A BRUSH OR BRISTLE HEAD

BACKGROUND OF THE INVENTION

1. Field of the Invention

The present invention relates to a razor and a method for producing a razor.

In the sense of the present invention, shaving is understood as meaning cutting the hairs on the skin to just above the uppermost layer of skin with at least one blade. This does not involve removing the hair, just shortening it.

2. Discussion of Background Information

Known razors comprise an elongate handle part, which is connected to a blade head. During use as intended, the handle part lies in the hand of the user, in order to allow the blade head to glide over the user's skin.

Such razors are usually used for wet shaving, but it is also possible that a razor in the sense of the present application also has a power supply (for example a battery or rechargeable battery), which causes a vibration in the blade head in order to bring about a massaging effect and/or increase the closeness of the shave.

These razors are available as disposable articles, with permanently installed or exchangeable blade heads and a wide variety of blade head variations with different numbers of razor blades.

DE 29503575 U describes a handle part for a razor which is provided at one end with a receiving device for a holder with blades arranged therein. The handle part is in this case configured as a leaf spring.

DE2851457A1 describes a razor cartridge with a blade seat, a razor blade and a cap, an integral solid, water-soluble shaving aid being provided.

DE20216827U1 describes a two-part shaving set for manual wet shaving consisting of a razor with a handle and a shaving brush. The hollow telescopic grip can alternately receive and conceal both the shaving brush and the cutting head with the razor blade block in its interior, the user using the same telescopic grip as a handle when lathering and when shaving.

US2008072431A1 describes a shaving device having multiple parallel blades with a flat part and curved end portions for shaving curved regions of the body.

U.S. Pat. No. 5,903,978A1 describes a curved razor handle.

SUMMARY OF THE INVENTION

An object of the invention is to provide an improved razor.

In one aspect, the invention relates to a razor with a handle having a handle part and a head part for receiving a blade head, and with the blade head, the blade head being designed as a brush head with bristles, at least one of the bristles having a razor blade.

The invention is based on the idea that a razor that has bristle-like razor blades can be used more satisfyingly and reliably for shaving. The bristles adapt themselves particularly flexibly to possible unevennesses or curvatures of the skin and thus make a particularly close shave possible even in regions of the skin that are difficult to access. The bristles glide smoothly over the skin, which makes shaving particularly satisfying for the user. This enables the user to have a close, satisfying shave without expending great force.

The blade head designed as a brush head has a main body, for example of plastic, the front side of which (the side that is facing away from the head part) forming the back of the brush/ferrule of the brush, on which the set of bristles comprising the at least one bristle with at least one razor blade is arranged.

The bristles may have different lengths, widths, cross-sectional forms etc. and also consist of different materials. Also, some of the bristles may not have a razor blade but only a balsam strip, in order to provide the user with skin care during the shave. Also, some of the bristles may not have a razor blade but just a special blade. It may, however, also be preferred that one or more bristles has/have not only one (or more) razor blades but also one (or more) special blades and/or one (or more) balsam strips.

A razor according to the invention advantageously makes it possible to perform shaving like a brush stroke. The blade head preferably has multiple, relatively small blades, which are arranged on bristles and are thus flexibly movable with respect to one another. A sensitive shave is made possible according to the invention, since the blades rest closer and more directly on the skin, which provides improved closeness of the shave especially around knees and ankles. An extremely sensitive shave in which only little pressure on the blade head is necessary is made possible. The razor blades of the bristles adapt themselves "as if of their own accord" to the surface of the user's skin.

In particularly preferred embodiments, the razor according to the invention has a blade head with razor blade bristles, which are arranged in a row next to one another. The individual razor blades are attached to elastic bristles that are flexibly movable with respect to one another (also referred to as "lamellae"). The bristles are anchored on a flat blade head, which acts as a kind of brush head, which is of an exchangeable design. The razor blade bristles consist for example of commercially available elastic material and are distinguished by their size and flexible use, which is similar to a brush stroke. The flexibility and smoothness of the shave can be ensured by elastic lamellae of a thermoplastic elastomer. The blades thus advantageously lie closer and more directly on the skin, and therefore a smaller pressure on the razor is required for shaving.

The flexibility and smoothness of the shave is ensured according to the invention by lower pressure on the razor and the flexible razor blades. The shave is thus ergonomically satisfying and reduces the risk of injuries in the form of cuts.

In one embodiment, the bristles have one or a multiplicity of razor blade(s). Each of the bristles may have one or more razor blade(s). The razor blade(s) is/are preferably arranged substantially at right angles to the longitudinal axis of the bristle(s). The razor blade(s) is/are arranged on a lower face of the bristle(s), which during use of the razor as intended glides over the user's skin in order to carry out the shaving. It may, however, also be preferred that only one or some of a multiplicity of bristles has/have one or more razor blade(s). The arrangement according to the invention of razor blade(s) on bristle(s) makes a particularly smooth and close shave possible, since the bristles adapt themselves particularly pliably to the unevennesses of the surface of the skin. If a razor has for example a multiplicity of bristles with a multiplicity of razor blades, they can come to lie particularly flexibly against an evenness of the skin (for example the ankle or the knee), in order to shave this region of the skin with only one or a few movements of the razor over this region.

In one embodiment, at least one of the bristles has (a) special blade(s) and/or (a) balsam strip(s). Each of the bristles may have one or more special blade(s) and/or balsam strip(s). The special blade(s) and/or balsam strip(s) is/are preferably arranged substantially at right angles to the longitudinal axis of the bristle(s). The one or more special blade(s) and/or balsam strip(s) is/are arranged on a lower face of the bristle(s), which during use of the razor as intended glides over the user's skin in order to perform the shaving and/or the skin care. The arrangement according to the invention of one or more special blade(s) and/or balsam strip(s) on bristle(s) makes a particularly smooth and close shave and skin care possible, since the bristles adapt themselves particularly pliably to the unevennesses of the surface of the skin. If a razor has for example a multiplicity of bristles with a multiplicity of one or more special blade(s) and/or balsam strip(s), they can come to lie particularly flexibly against an evenness of the skin (for example the ankle or the knee), in order to shave, and thereby at the same time care for, this region of the skin with only one or a few movements of the razor over this region.

The razor may advantageously be supplemented by one or more special blade(s). The blade head therefore preferably has different types of blade, which makes an improved, more precise shave possible in different regions of the user's skin. Thus, for example, the razor blade(s) of the blade head may be suitable for shaving over a large area, which may be refined by the use of one or more smaller special blade(s) arranged on one or more bristle(s). Depending on requirements, different blade heads with different special blades may be arranged on the razor, whereby the applicational flexibility is advantageously increased.

A balsam strip in the sense of the present application may be a strip that comprises for example a shaving soap, a moisturiser, a soothing skincare product, an oil or the like. It is preferred to arrange the balsam strip along the longitudinal axis of a bristle adjacent the at least one razor blade and/or the at least one special razor blade on the bristle. This advantageously achieves the effect that the skin is not only shaved but also treated and cared for by the balsam strip.

In one embodiment, the razor blade (and/or special blade) is formed as a notch and/or cut in the bristle surface. The at least one razor blade is preferably formed on the at least one bristle, in that the bristle has an incision on the lower face of the bristle, which during use of the razor as intended rests on the skin to be shaved of the user. The incision is made substantially at right angles to the longitudinal axis of the bristle. The incision may be formed as a wedge-shaped notch, which tapers in the direction of the tip of the bristle. In the case of such an embodiment, the notch is only activated as a razor blade when the bristle rests on the surface of the skin and is deflected under the bearing pressure, which leads to a curving of the bristle, and consequently spreading of the notch. The bristle surface on the lower face of the bristle consequently has a substantially smooth surface in the unused state, whereby injuries in the form of cuts or damage to the bristles and caused by the bristles can be advantageously prevented. Only when the bristle is curved during use as intended is the razor blade of the notch exposed in order to make shaving possible.

In one embodiment, the bristles comprise an elastic material. The bristles may be produced from the same material, or it may be preferred that the bristles arranged on the outside of the blade head are formed from a material with lower elasticity than the bristles arranged in between. It is in this way advantageously made possible that the unevenness of the skin of a knee or ankle can be replicated particularly well by the bristles with differing elasticity or firmness brushing over it.

In one embodiment, the bristles are arranged next to one another and parallel to one another on the head part. The blade head is preferably formed as a flat brush head. Preferably, a row of bristles is arranged next to one another on the blade head (preferably substantially along the transverse axis). It may be preferred that the bristles are arranged parallel to one another or as a fan. Depending on use for different regions of the user's body, blade heads with a differing design and arrangement of the bristles may be arranged on the head part.

In one embodiment, the blade head is formed concavely along the transverse axis of the razor. It is advantageously achieved that the blade head has a curvature that substantially corresponds as a mirror image to a curvature of the surface of the user's skin. It may be preferred that blade heads with different radii of curvature (which are adapted to different regions of the surface of the user's skin) can be arranged on the razor. With a curved design of the blade head, the lower face of the blade head, and consequently of the bristles arranged on it, can glide particularly well on the user's skin during use of the razor as intended. In a preferred embodiment, the bristles are therefore arranged along a curved line or row (front end of the blade head), so that they adapt themselves particularly well to the curved surface of the user's skin. In one embodiment, a row of bristles is formed as at least partially concavely curved. In a preferred embodiment, the head part of the handle may also be formed concavely along the transverse axis of the razor.

In one embodiment, the handle is formed convexly along the longitudinal axis of the razor. It may also be preferred that the handle is described in a slightly bent form and consists of strong, impact-resistant material (for example ABS (acrylonitrile butadiene styrene)). A convexly curved handle can be used ergonomically more satisfyingly and also more reliably for shaving, since the handle or handle part of a substantially adapted to the concavely curved palm of the hand makes particularly ergonomic handling possible.

In one embodiment, the head part has a recess, in which the blade head is detachably arranged. The connection between the blade head and the head part preferably takes place by way of a simple click mechanism (recess on the head part and projection on the blade head engaging therein or recess on the blade head and projection on the head part engaging therein), which makes changing of the blade head possible particularly easily. The blade head is preferably detachably connected to the head part by means of the recess. In one embodiment, the blade head is fixed in the recess by means of retaining elements, for example locked by means of latching elements. Bringing about the fixing of the blade head just by means of a form fit or simple retaining elements in the recess advantageously allows a planar surface of the razor to be provided, which improves the handling and makes a satisfying shave possible.

In one embodiment, the handle part has at least one grip element for nonslip holding of the handle by the user. In one embodiment, the upper face of the handle part has grip elements for the nonslip holding of the handle by the user. The handling of the razor and its hold in the hand of the user can be advantageously improved further by grip elements, such as for example roughened regions, a grooving, an adhesive surface, regions of a nonslip material, being provided on the upper face (or else in an optional concave curvature of the lower face) and/or concave/convex curvatures being provided. Thus, the handle advantageously lies particularly well in the hand, particularly safe handling of the razor is made possible and "slipping away" of the razor is prevented.

On account of its flexible possibilities for use, the razor according to the invention is advantageously suitable for shaving part of or the whole body, and in particular for shaving under a shower.

In a further aspect, the invention relates to a method for producing a razor of the present invention, with the steps of: providing a handle having a handle part and a head part for receiving a blade head, and arranging the blade head on the head part, the blade head being designed as a brush head with bristles, at least one of the bristles having a razor blade.

In a further (second) aspect, the invention relates to a razor with a handle having a handle part and a flexibly bendable head part, and with a blade head integrated with a form fit in the head part, the blade head being designed as a brush head with a single bristle, which has at least one razor blade.

The razor of this second aspect can advantageously be operated particularly easily, since it has only a single bristle. Furthermore, it is very small and therefore well suited for transport. With this razor, which is formed as a kind of spring, even regions of the body that are particularly uneven or difficult to access can be shaved particularly closely.

In a preferred embodiment, the blade head and/or the bristle has/have one or more pressure points, which visually indicate to the user whether and/or how much pressure is being applied between the bristle and the user's skin during use of the razor as intended. The user can thus advantageously detect particularly well whether the region of the skin to be shaved has been subjected to sufficient pressure for shaving.

In a preferred embodiment, the head part and the handle part are formed in one piece. In a further preferred embodiment, the blade head is arranged non-detachably in the head part. In a further embodiment, the razor has a slide element (preferably a slide pin), which is designed for changing the flexible bendability (possible curvature under deflection) of the head part).

In a preferred embodiment, the blade head comprises one or more blade(s), the cutting edges of which form a plane. The cutting-edge plane of the blade(s) advantageously lies in a plane formed with the skin resting side of the head part. The skin resting side is the lower face of the head part during use of the razor as intended. The blade head lies substantially in the plane of the lower face, in order to make possible a smooth lower face of the razor that glides particularly satisfyingly over the skin. This also achieves the effect that there are no protruding blade edges or fastening elements that could disturb shaving (since the blade head is integrated with a form fit in the head part). Furthermore, the substantially flat resting surface of the lower face of the head part on the skin offers certainty in preventing the blade head from skewing on the skin and injuring it.

In a further aspect, the invention relates to a shaving set with: a razor according to one of the aforementioned aspects (preferably the second aspect) of the present invention, and a holder for receiving at least part of the razor in a form-fitting manner.

BRIEF DESCRIPTION OF THE DRAWINGS

The embodiments described above may be combined with one another and with the aspects described above as desired in order to achieve advantages according to the invention. Preferred combinations of embodiments are described below by way of example, while.

DETAILED DESCRIPTION OF EMBODIMENTS OF THE INVENTION

Figure 1A:
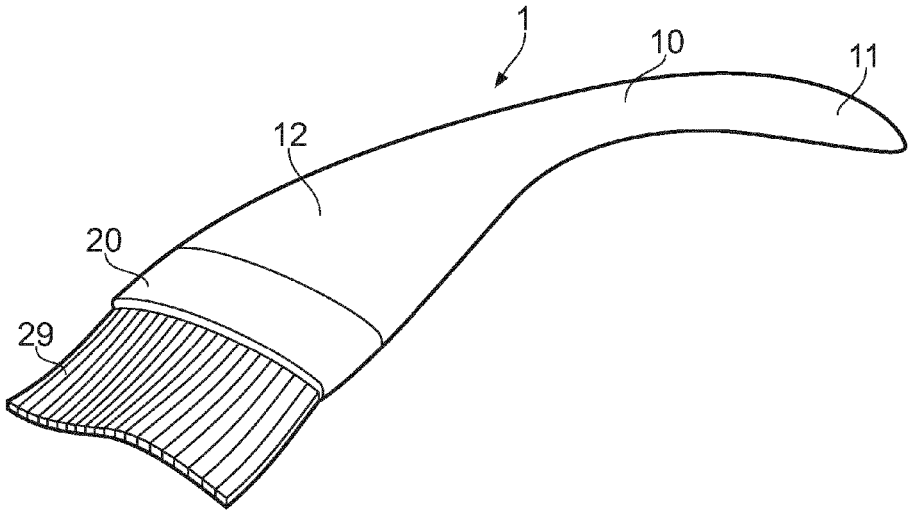
FIGS. 1*a* to 1*d* show an embodiment of a razor according to the invention.
Figure 1B:
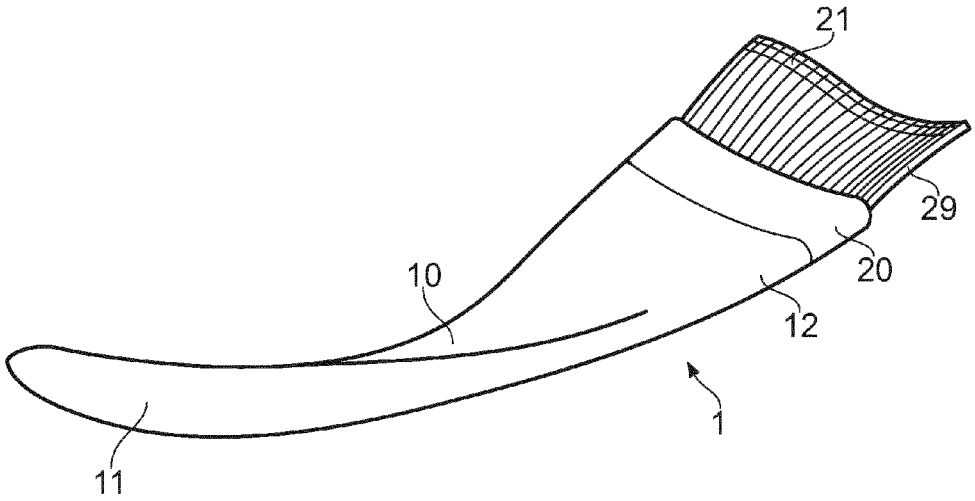
Figure 1C:
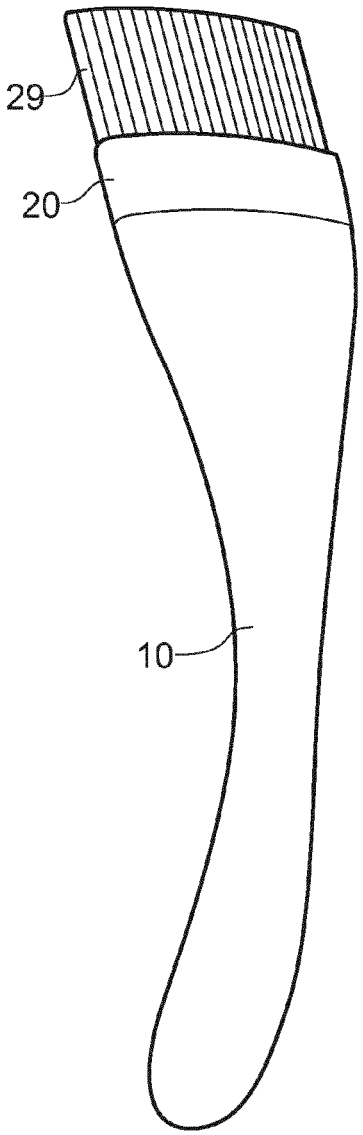
Figure 1D:
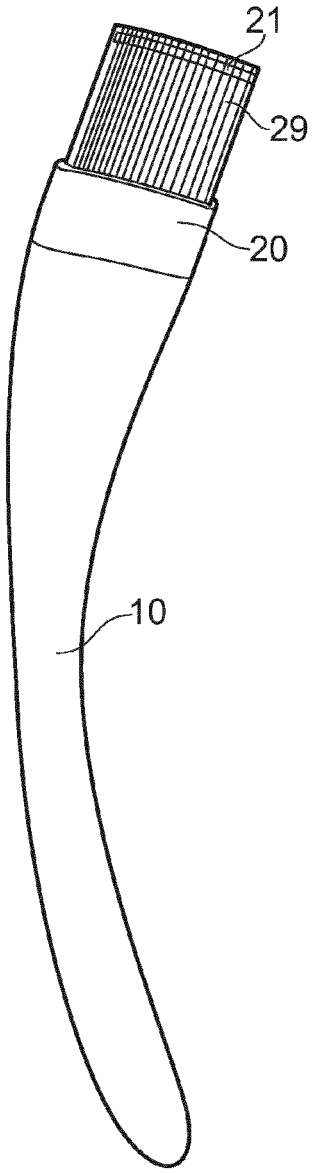
Figure 2A:
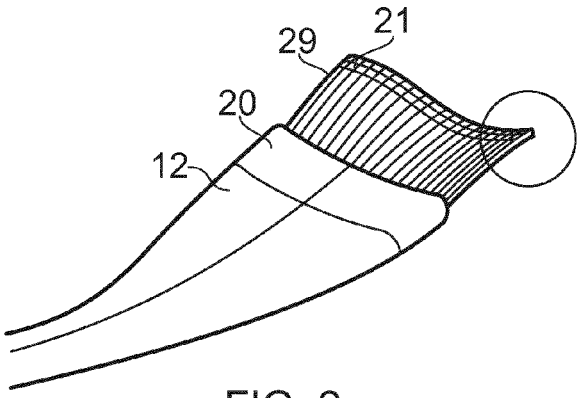
FIGS. 2*a* and 2*b* show views of details of the embodiment of FIG. 1.
Figure 2B:
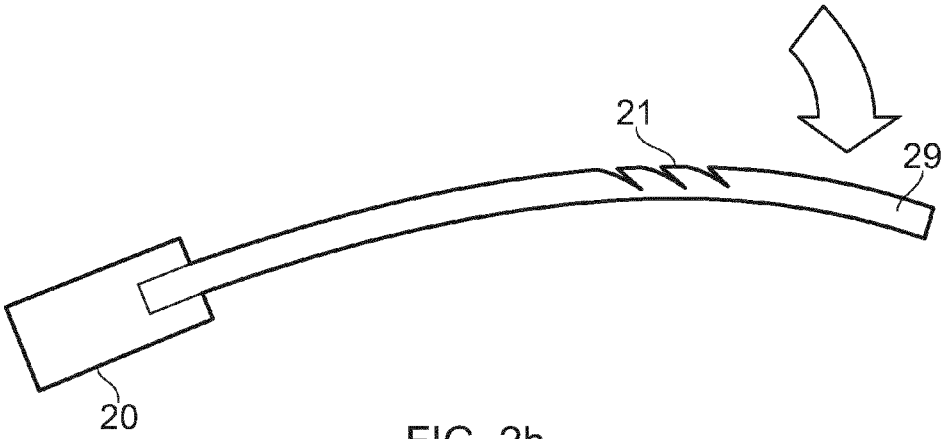
Figure 3:
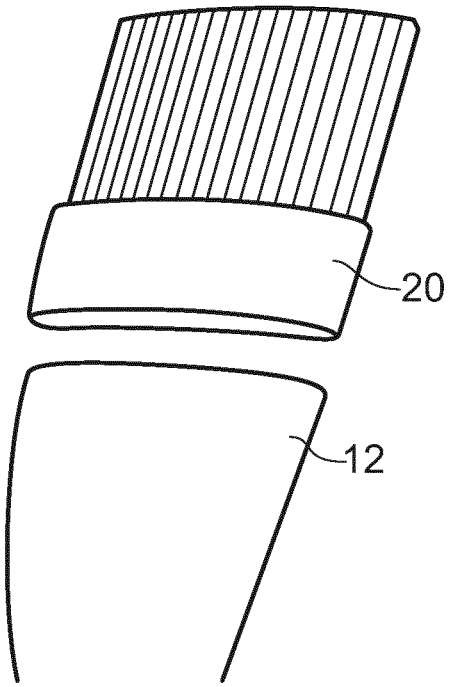
FIG. 3 shows the detachability of the blade head from the head part of the embodiment of FIG. 1.

FIGS. 1*a* and 1*c* show a razor 1 from above, and FIGS. 1*b* and 1*d* show it from below. FIGS. 2*a* and 2*b* show views of details of the blade head 20. FIG. 3 illustrates the procedure for a change of the blade head.

The razor 1 has a handle 10 with a handle part 11 and a head part 12. The head part 12 has in turn the blade head 20, which is equipped with at least one razor blade 21 on at least one bristle 29. In the embodiments shown in FIGS. 1 to 5, the blade head 20 has a multiplicity of bristles 29 with a multiplicity of razor blades 21.

The blade head 20 is arranged in a recess, which is located at the front end of the head part 12. The blade head 20 is locked in the recess advantageously by means of retaining elements and can be detached from them in order to insert a new blade head 20, for example when the razor blades 21 have become blunt or a blade head 20 with different kinds of bristles 29 is to be used.

The handle 10 may have grip elements (not represented), which make nonslip holding of the handle by the user possible. The blade head 20 or the bristles 29 may have balsam strips (not represented) with emulsions and nourishing oils and/or special blades (not represented).

It is shown in FIGS. 1 and 2*a* that the handle 10 is formed convexly along the longitudinal axis of the razor 1 and the blade head 20 is formed concavely along the transverse axis of the razor 1. The bristles 29 are of an elastic material and are arranged next to one another and substantially parallel to one another on the head part 20.

In FIG. 2*b* it is shown by way of example how multiple razor blades 21 are formed as notches in the bristle 29. The bristle 29 is anchored on the blade head 20 and formed from an elastic material, which is indicated in FIG. 2*b* by the arrow. If the bristle 29 is deflected, in that it is resting on the user's skin and gliding over it, the razor blades 21 are spread open, in that the bristle 29 is curved, and thereby activated. If the bristle 29 is relieved, in that it is removed from the skin, the bristle 29 assumes its original form and the notch closes again, so that the razor blade 21 is deactivated.

Figure 4A:
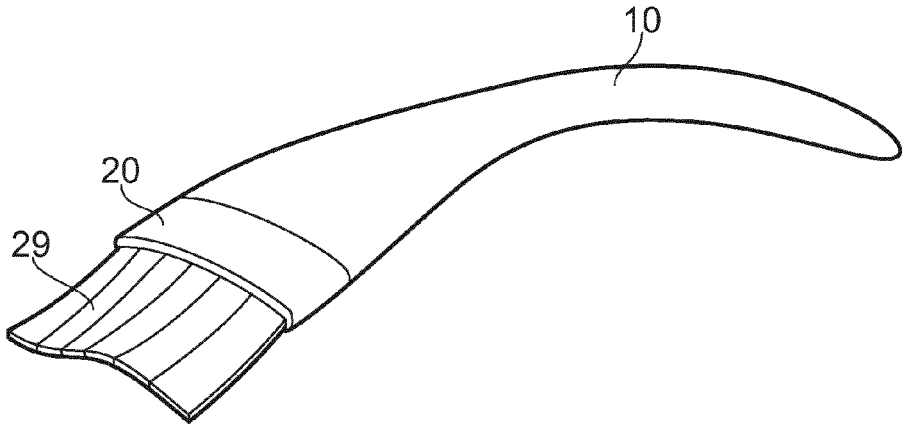
FIGS. 4*a* and 4*b* show a further embodiment of a razor according to the invention.
Figure 4B:
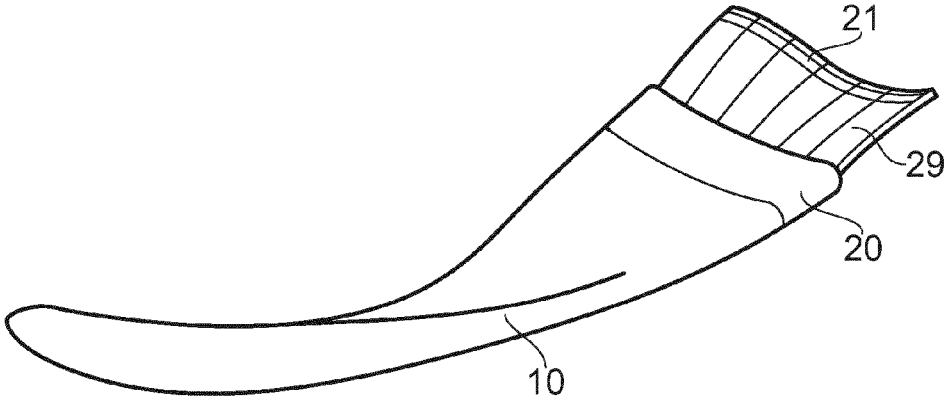
Figure 5A:
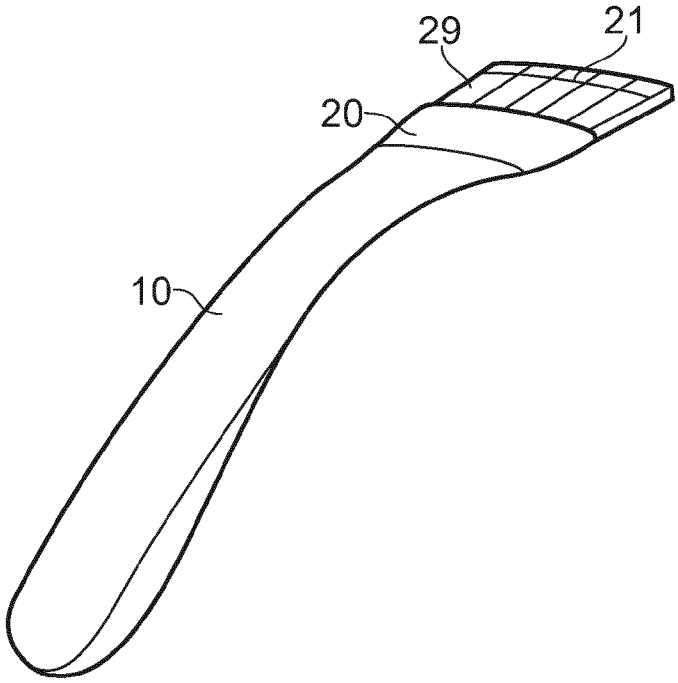
FIGS. 5*a* to 5*c* show a further embodiment of a razor according to the invention.
Figure 5B:
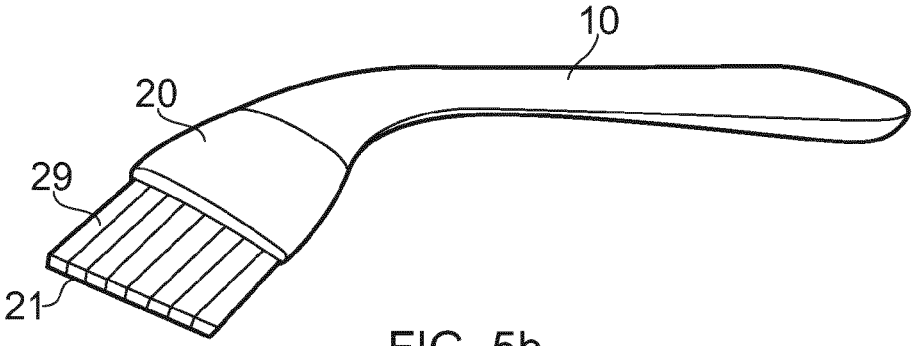
Figure 5C:
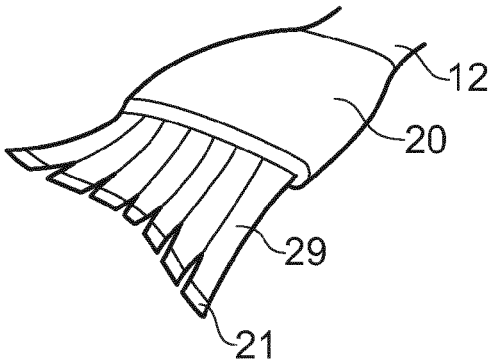

FIGS. 4 and 5 illustrate further embodiments of the razor 1. To the extent to which the features of the further embodiments coincide with those of the embodiments previously described, reference is made to the features described above.

The embodiment of FIG. 3 differs from the embodiment of FIG. 1 substantially in the design of the bristles 29, which are designed to be wider in FIG. 3 than in FIG. 1. The head part 12 of FIG. 3 corresponds substantially to that of FIG. 1, which illustrates the exchangeability of the blade heads 20. Depending on requirements, it may therefore be advantageous to use a blade head 20 with wide bristles 29 (FIG. 3) for relatively flat portions of the user's skin and a blade head 20 with narrow bristles 29 (FIG. 1) for relatively uneven portions of the user's skin.

The embodiment of FIG. 4 differs from the embodiments of FIGS. 1 and 3 substantially in the form of the handle 10 and the arrangement of the razor blades 21. In the case of the embodiment of FIG. 4, the razor blades 21 are arranged at the tip of the bristle, whereas in the case of the embodiments of FIGS. 1 and 3 they are arranged in a region of the tip (front half, front third of the bristle 29), but not at the tip.

The embodiments of FIGS. 1 to 5 therefore have razor blades 21 that are flexibly movable with respect to one another (in particular next to one another), the razor blades 21 being arranged next to one another in a row on bristles 29. On each bristle 29 (elastic lamella), individual razor blades 21 may in turn be attached movably with respect to one another (one behind the other). The lamellae 29 are anchored on a flat blade head or brush head 20, which at the same time represents the changing unit for the razor 1.

The razor blades 29 may be anchored in the bristle 29 as commercially available blades or be formed as a notch in the bristle surface. The razor blades 29 are distinguished in particular by their size and flexible use, which is similar to a brush stroke. The flexibility and smoothness of the shave is also ensured by the elastic lamellae 29 of thermoplastic elastomer. The razor blades 21 thus advantageously lie closer and more directly on the skin. Therefore, a smaller pressure on the razor 1 is required for shaving. Shaving with the razor 1 is ergonomically satisfying and protects against injuries in the form of cuts.

The handle 10 is ergonomic, described in a slightly bent form and consists of strong, impact-resistant material (for example ABS (acrylonitrile butadiene styrene)) and may also be covered with grip elements such as roughened zones, grooving and nonslip materials.

FIGS. 6 to 9 illustrate embodiments of the second aspect of the present invention.

Figures 6A, 6B:
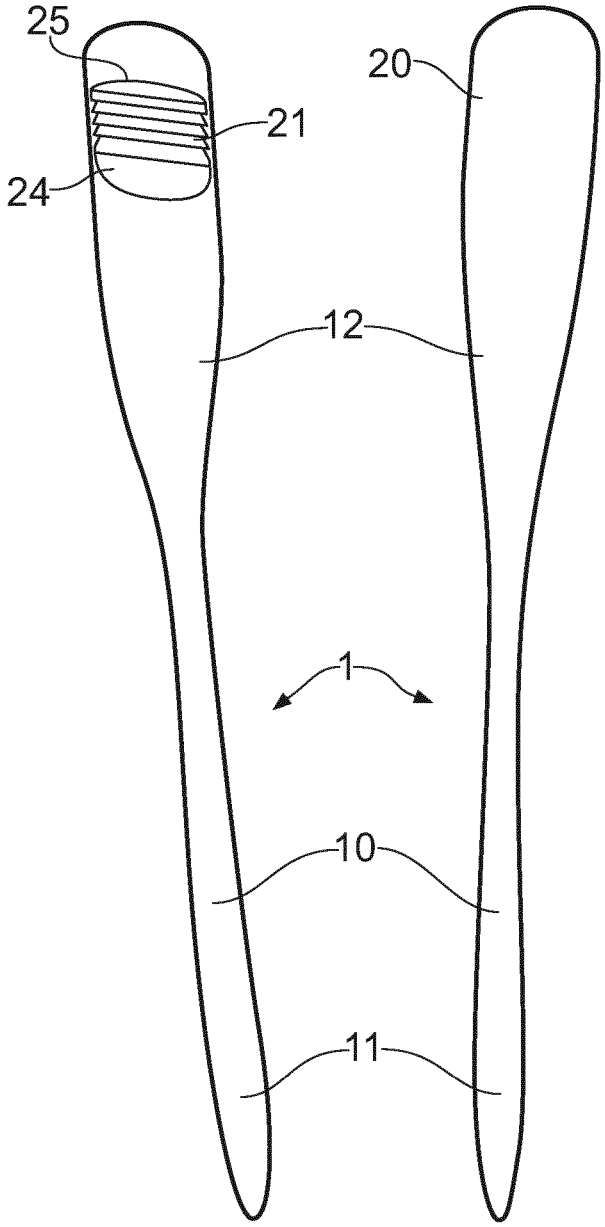
FIGS. 6*a* to 6*c* show an embodiment of a razor according to the invention according to the second aspect.
Figure 6C:
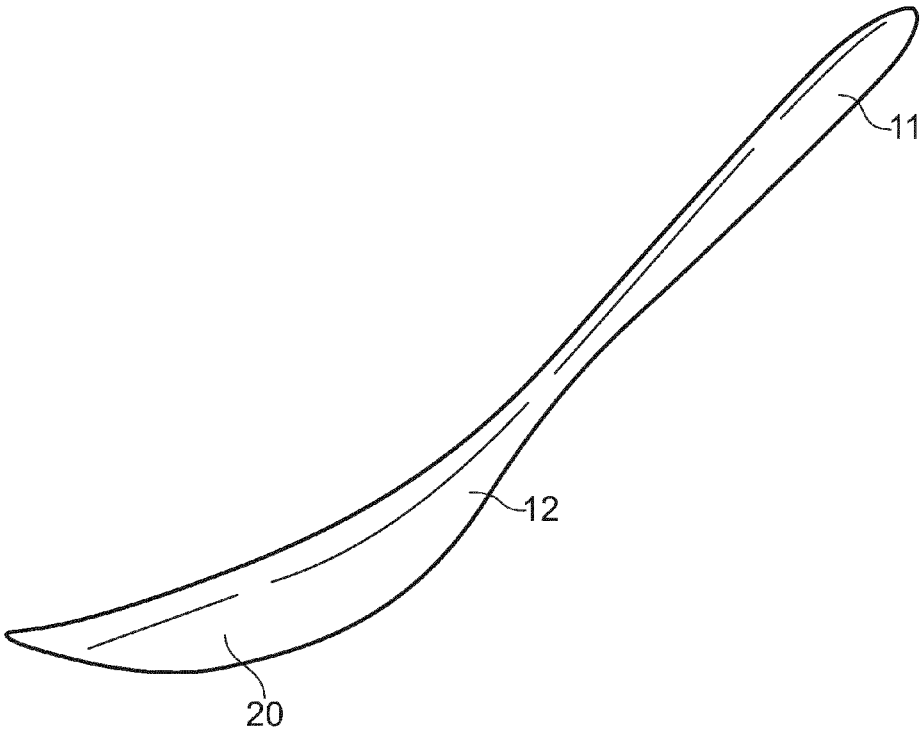

FIG. 6*a* shows a razor 1 from below, FIG. 6*b* shows it from above and FIG. 6*c* shows it during use as intended on the user's skin.

The razor 1 has a handle 10 with a handle part 11 and a flexibly bendable head part 12 and a blade head 20 integrated in the head part 12 in a form-fitting manner. The blade head 20 is designed as a brush head with a single bristle 20, 29, which has at least one razor blade 21.

Arranged along with the razor blades 21 are balsam strips 24, 25, which with each brush stroke or resilient stroke of the razor 1 over the user's skin provide care for it. The blade head 20 has multiple blades 21, the cutting edges of which substantially form a plane with the lower face of the head part 12 (skin resting side).

The head part 12 and the handle part 11 are formed in one piece and the head part 12 is made wider than the handle part 11. The blade head 20 is arranged non-detachably in the head part 12.

Figure 7:
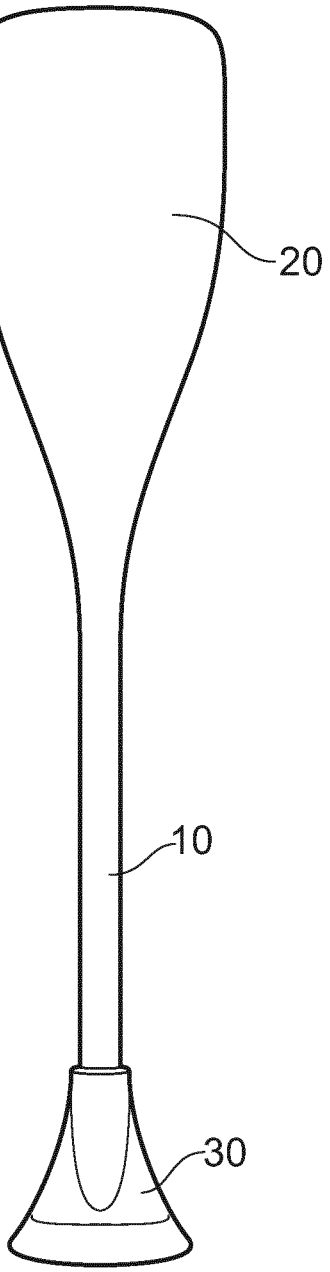
FIG. 7 shows an embodiment of a shaving set according to the invention.

FIG. 7 shows a shaving set with a razor 1 of FIG. 6, and a holder 30 for receiving the handle 10 or handle part 11 of the razor 1 in a form-fitting manner.

Figure 8A:
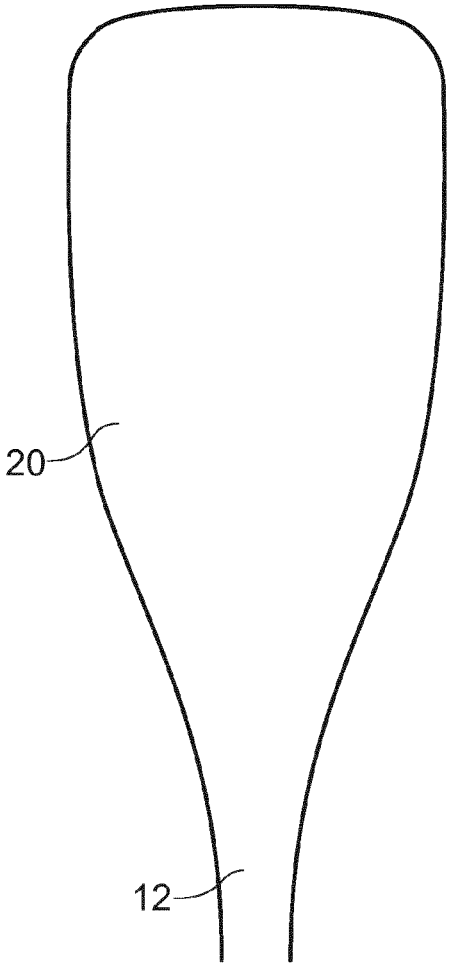
FIGS. 8*a* to 8*c* show a further embodiment of a razor according to the invention according to the second aspect.
Figure 8B:
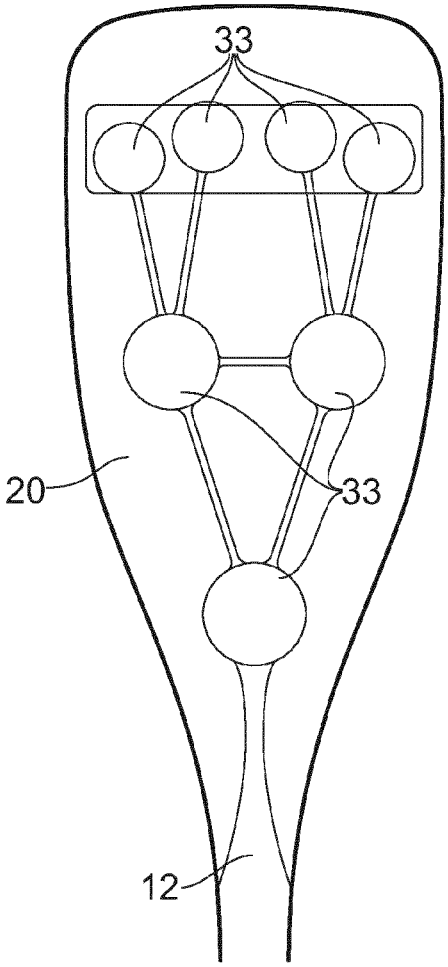
Figure 8C:
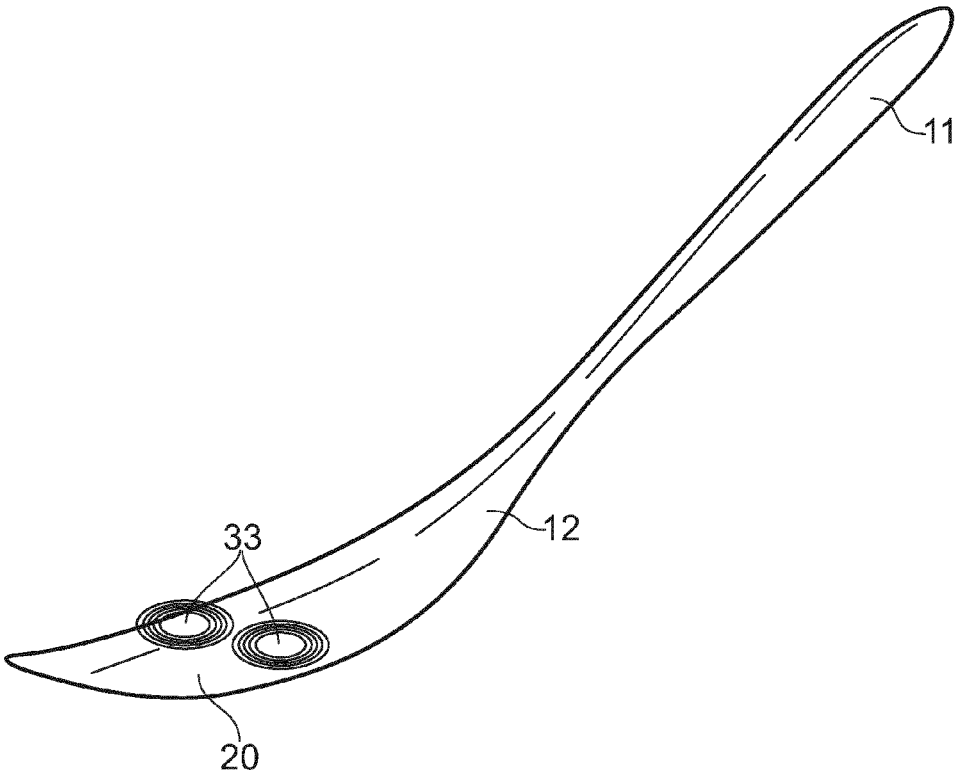

Illustrated in FIG. 8 is a razor 1 of which the blade head 20 has multiple pressure points 33, which visually indicate to the user whether and/or how much pressure is being applied between the blade head 20 and the user's skin during use of the razor 1 as intended. The pressure points 33 may for example comprise pressure sensors or temperature sensors.

For example, in the pressure points there may be integrated piezo elements, which then emit optical or electrical signals according to the pressure.

Figure 9A:
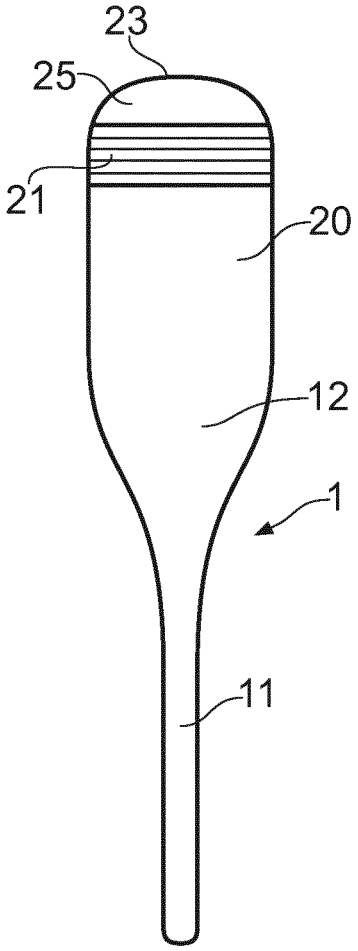
FIGS. 9*a* to 9*c* show a further embodiment of a razor according to the invention according to the second aspect.

Illustrated in FIG. 9 is a razor 1, which has on the blade head 20 a multiplicity of razor blades 21, a balsam strip 25 and a special blade 23. The special blade 23 arranged at the tip may be used for fine shaving or for shaving particularly uneven portions of the skin.

Figure 9B:
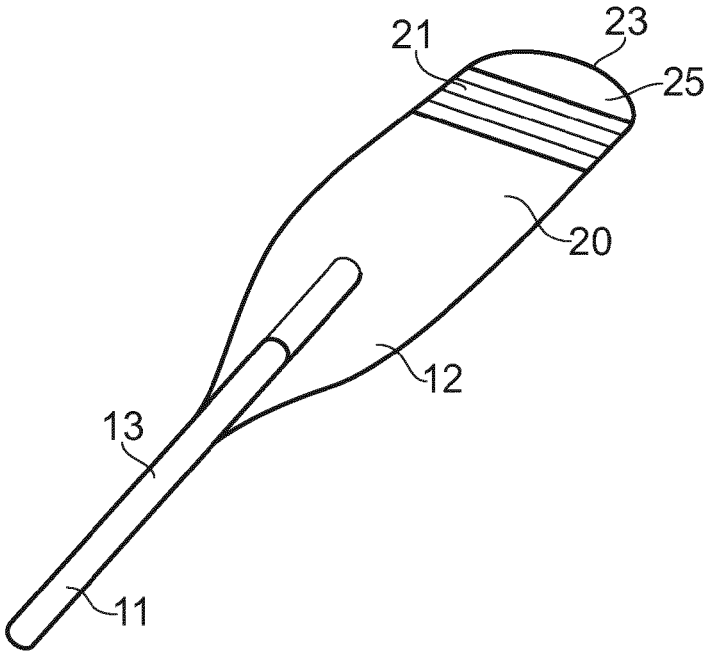
Figure 9C:
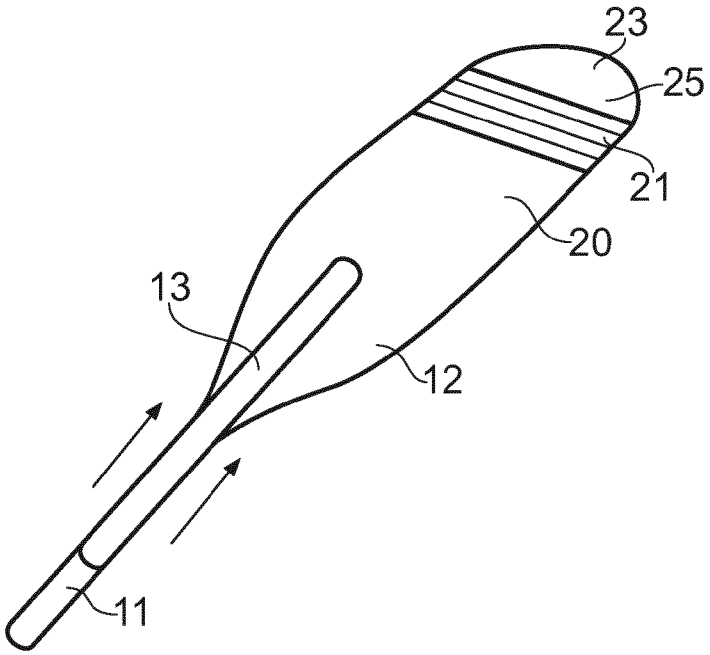

The razor 1 of FIGS. 9*b* and 9*c* additionally has a slide pin 13, which is designed for changing the flexible bendability (possible curvature under deflection) of the head part 20. Thus, the head part 20 in FIG. 9*b* can perform a relative, great deflection, whereas the slide pin 13 in FIG. 9*c* blocks or hinders the deflection of the head part 20.

The slide pin is advantageously of a material with a different elasticity than the material of the handle in order to achieve changing of the deflection.

LIST OF REFERENCE NUMERALS

1 Razor
10 Handle
11 Handle part
12 Head part
13 Slide pin
20 Blade head
21 Razor blades
22 Recess
23 Special blade(s)
24 Balsam strip
25 Balsam strip
29 Bristles
30 Holder
33 Pressure sensors

What is claimed is:

1. A razor, wherein the razor comprises a blade head and a handle which comprises a handle part and a head part for receiving the blade head, the blade head being designed as a brush head with one or more bristles made of an elastic material, and at least one bristle of the one or more bristles having at least one razor blade arranged thereon, and wherein at least one of (i) the one or more bristles are made of a thermoplastic material, (ii) more than one razor blade is arranged on the at least one bristle, (iii) the at least one razor blade is arranged in a region of a tip of the at least one bristle, but not at the tip of the at least one bristle, and (iv) the one or more bristles comprise several bristles which are arranged in the form of a fan.

2. The razor of claim 1, wherein the at least one razor blade is arranged on a lower face of the at least one bristle.

3. The razor of claim 1, wherein the at least one razor blade is arranged substantially at a right angle to a longitudinal axis of the at least one bristle.

4. The razor of claim 1, wherein the one or more bristles are made of a thermoplastic elastomer.

5. The razor of claim 1, wherein more than one razor blade is arranged on the at least one bristle.

6. The razor of claim 1, wherein the at least one razor blade is arranged in a region of a tip of the at least one bristle, but not at the tip of the at least one bristle.

7. The razor of claim 1, wherein the at least one razor blade is present in a notch in a surface of the at least one bristle.

8. The razor of claim 1, wherein the one or more bristles comprise several bristles which are arranged in the form of a fan.

9. The razor of claim 1, wherein the head part and the handle part are formed in one piece.

10. The razor of claim 1, wherein the blade head is formed concavely along a transverse axis of the razor.

11. A method for producing the razor of claim 1, wherein the method comprises:

providing a handle comprising a handle part and a head part for receiving the blade head, and arranging the blade head on the head part, the blade head being designed as a brush head with one or more bristles made of an elastic material, at least one bristle of the one or more bristles having at least one razor blade arranged thereon, and at least one of (i) the one or more bristles being made of a thermoplastic material, (ii) more than one razor blade being arranged on the at least one bristle, (iii) the at least one razor blade being arranged in a region of a tip of the at least one bristle, but not at the tip of the at least one bristle, and (iv) the one or more bristles comprising several bristles which are arranged in the form of a fan.

12. A razor, wherein the razor comprises a blade head and a handle which comprises a handle part and a head part for receiving the blade head, and wherein the blade head is designed as a brush head comprising one or more bristles made of a thermoplastic elastomer, at least one bristle of the one or more bristles having at least one razor blade arranged on a lower face thereof.

13. A razor, wherein the razor comprises a blade head and a handle which comprises a handle part and a head part for receiving the blade head made of a thermoplastic elastomer, and wherein the blade head is designed as a brush head with one or more bristles, at least one bristle of the one or more bristles having at least one razor blade arranged thereon in a region of a tip of the at least one bristle, but not at the tip of the at least one bristle.

* * * * *